US011220770B2

(12) United States Patent
Chen

(10) Patent No.: US 11,220,770 B2
(45) Date of Patent: Jan. 11, 2022

(54) PORTABLE PATCHWORK SEWING TOOL KIT

(71) Applicant: Chi-Jen Chen, Xihu Township, Changhua County (TW)

(72) Inventor: Chi-Jen Chen, Xihu Township, Changhua County (TW)

( * ) Notice: Subject to any disclaimer, the term of this patent is extended or adjusted under 35 U.S.C. 154(b) by 63 days.

(21) Appl. No.: 16/809,922

(22) Filed: Mar. 5, 2020

(65) Prior Publication Data

US 2021/0277558 A1 Sep. 9, 2021

(51) Int. Cl.
*D05B 91/06* (2006.01)
*D06F 81/00* (2006.01)
*D05B 97/12* (2006.01)

(52) U.S. Cl.
CPC ..... *D05B 91/06* (2013.01); *D05B 97/12* (2013.01); *D06F 81/00* (2013.01); *D05D 2305/08* (2013.01); *D05D 2305/26* (2013.01)

(58) Field of Classification Search
CPC ..... D05B 91/00; D05B 91/06; D05B 97/12; D06F 81/00; D05D 2305/08; D05D 2305/26; D05D 2305/265; D05D 2305/32; B26B 29/06; B26D 7/015; G01B 3/004
See application file for complete search history.

(56) References Cited

U.S. PATENT DOCUMENTS 2,771,187 A * 11/1956 Clement ..... B65D 85/24 206/380
3,301,295 A * 1/1967 Fitch ..... A45C 1/06 190/100
5,557,996 A * 9/1996 Reber ..... B25H 7/02 30/292
10,190,245 B1 * 1/2019 Cutler ..... D05B 97/12
2004/0121095 A1 * 6/2004 Thuma ..... B32B 5/26 428/34.1
2005/0252428 A1 * 11/2005 Yamin ..... D06H 7/00 108/139
2006/0060052 A1 * 3/2006 Okada ..... A47J 47/005 83/659
2006/0213093 A1 * 9/2006 Krotts ..... D06F 83/00 38/140
2007/0289425 A1 * 12/2007 Chen Lin ..... A47J 47/005 83/574
2015/0069691 A1 * 3/2015 Chen ..... A47J 47/005 269/55
2015/0267334 A1 * 9/2015 Works ..... D05B 97/12 33/566

* cited by examiner

*Primary Examiner* — Nathan E Durham

(74) *Attorney, Agent, or Firm* — Egbert, McDaniel & Swartz, PLLC

(57) ABSTRACT

A portable patchwork sewing tool kit includes: a base plate, the inner face thereof is provided with a first page and a second page which can be folded or unfolded optionally; a rotary cutting mat fixed to the first page, the rotary cutting mat comprises a bottom plate and a cutting plate pad screwed on the bottom plate through a pivot joint base to be rotated under stress; a detachable ironing mat fixed to the second page, including a core board, a cotton spreading layer covering the core board and a cotton fabric surface layer covering the cotton spreading layer, an ironing face formed outside the cotton fabric surface layer; and a plurality of pushing edges formed around the cutting plate pad and spaced apart.

14 Claims, 6 Drawing Sheets

PORTABLE PATCHWORK SEWING TOOL KIT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a tool kit product for patchwork sewing, and more particularly to an innovative structure type of a portable patchwork sewing tool kit.

2. Description of Related Art Including Information Disclosed Under 37 CFR 1.97 and 37 CFR 1.98

The cutting mat and ironing mat are important among sewing tools. The former one is used as the pad for cutting fabric, paper or leather to prevent the cutting knife from cutting the table top. The latter one is used as the pad for ironing fabric, so as to achieve the ironing effect with better slip resistance.

For general sewing operations, the area of the material to be handled is large, so the area of the required cutting mat and ironing mat is large. However, the teaching industry of such sewing handicrafts as patchwork bags and rag babies on the market develops rapidly, the demand for related supplies grows greatly. Considering the sewing handicraft users' requirement for portability, related circles have released a binder-like structure type, a small cutting mat and a small ironing mat are fixed to the left and right faces of said binder-like structure in open mode, forming a portable sewing tool kit.

However, said known portable sewing tool kit still has insufficient convenience in practice. For example, the cutting mat is a fixed plate type, and the user has to turn the wrist or move the body to cut an arc, a round or a curve shape or to change the cutting direction, leading to inconvenient cutting. Moreover, the ironing mat is fixed, resulting in poor flexibility and non-ideal convenience of replacement and cleaning.

BRIEF SUMMARY OF THE INVENTION

The primary object of the present invention is to provide a portable patchwork sewing tool kit. The technical problem to be solved is to break through how to develop a novel portable patchwork sewing tool kit structure type with more ideal practicability, as well as portability and better flexibility of cutting and ironing operation.

Based on said object, the technical characteristic of problem solving of the present invention is that said portable patchwork sewing tool kit comprises a base plate with an inner face and a back side, wherein the inner face is provided with a first page and a second page which can be closed or opened optionally, and the first page and the second page are connected by a folding joint page; a rotary cutting mat, including a cutting plate pad with a cutting face and a friction surface; a bottom plate, superposed under the cutting plate pad, the bottom plate has an upper side face and a lower side face, there is a stepped axle hole in the bottom plate, and the stepped axle hole vertically penetrates through the upper side face and lower side face, wherein the upper side face is provided for overlapping the friction surface of cutting plate pad downwards, the lower side face is fixed to the first page of base plate. The stepped axle hole comprises a first hole part and a second hole part with different hole sizes and an annular shoulder between the first hole part and the second hole part; a pivot joint base, screwed in the stepped axle hole, the pivot joint base comprises a hole enlargement part and a coupling part with different outside diameters, the hole enlargement part is aligned with the first hole part of stepped axle hole, the coupling part is aligned with the second hole part of stepped axle hole. The coupling part has an end face, and the end face is upwards fixed to the friction surface of cutting plate pad, so that the cutting plate pad is screwed on the bottom plate through the pivot joint base and rotatable and restrained; a detachable ironing mat, fixed to the second page of base plate, the detachable ironing mat comprises a core board, a cotton spreading layer covering the core board and a cotton fabric surface layer covering the cotton spreading layer, wherein at least an ironing face is formed outside the cotton fabric surface layer; a plurality of pushing edges formed around the cutting plate pad and spaced apart, said pushing edges are concave or convex.

Based on the innovative unique structure type and technical characteristic, in comparison to prior art, said rotary cutting mat and detachable ironing mat of the present invention can be stored in a base plate structure, and there are pushing edges formed around the cutting plate pad, so as to achieve such practical progressiveness as portability, light weight, easy turning, convenient replacement and cleaning, better flexibility of cutting and ironing operation.

DETAILED DESCRIPTION OF THE INVENTION

FIG. 1 to FIG. 8 show the preferred embodiments of the portable patchwork sewing tool kit of the present invention, but the embodiments are for illustration only, the patent application is not limited to this structure.

Figure 5:
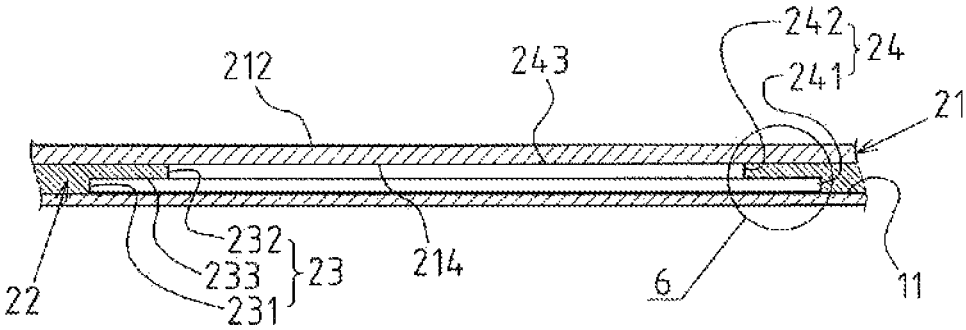
FIG. 5 is the 5-5 sectional view of FIG. 4.

Said portable patchwork sewing tool kit 100 comprises a base plate 10 with an inner face and a back side, the inner face is provided with a first page 11 and a second page 12 which can be folded or unfolded optionally, and the first page 11 and the second page 12 are connected by a folding joint page 13; a rotary cutting mat 20, including a cutting plate pad 21 with a cutting face 212 and a friction surface 214; a bottom plate 22, superposed under the cutting plate pad 21, the bottom plate 22 has an upper side face 221 and a lower side face 223, there is a stepped axle hole 23 in the bottom board 22, and the stepped axle hole 23 vertically penetrates through the upper side face 221 and the lower side face 223, wherein the upper side face 221 is provided for overlapping the friction surface 214 of the cutting plate pad 21 downwards, the lower side face 223 is fixed to the first page 11 of the base plate 10, the stepped axle hole 23 is shown in FIG. 5, comprising a first hole part 231 and a second hole part 232 with different hole sizes and an annular shoulder 233 between the first hole part 231 and the second hole part 232; a pivot joint base 24 screwed in the stepped axle hole 23, the pivot joint base 24 comprises a hole enlargement part 241 and a coupling part 242 with different outside diameters, wherein the hole enlargement part 241 is aligned with the first hole part 231 of the stepped axle hole 23, and the coupling part 242 is aligned with the second hole part 232 of the stepped axle hole 23. The coupling part 242 has an end face 243, and the end face 243 is upwards fixed to the friction surface 214 of the cutting plate pad 21, so that the cutting plate pad 21 is screwed on the bottom plate 22 through the pivot joint base 24 and rotatable and restrained; a detachable ironing mat 30 installed on the second page 12 of the base plate 10, the detachable ironing mat 30 is shown in FIG. 7, comprising a core board 31, a cotton spreading layer 32 covering the core board 31 and a cotton fabric surface layer 33 covering the cotton spreading layer 32, wherein at least an ironing face is formed outside the cotton fabric surface layer 33; a plurality of pushing edges 216 formed around the cutting plate pad 21 and spaced apart (as shown in FIG. 2 and FIG. 3), said pushing edges 216 are concave or convex.

Figure 1:
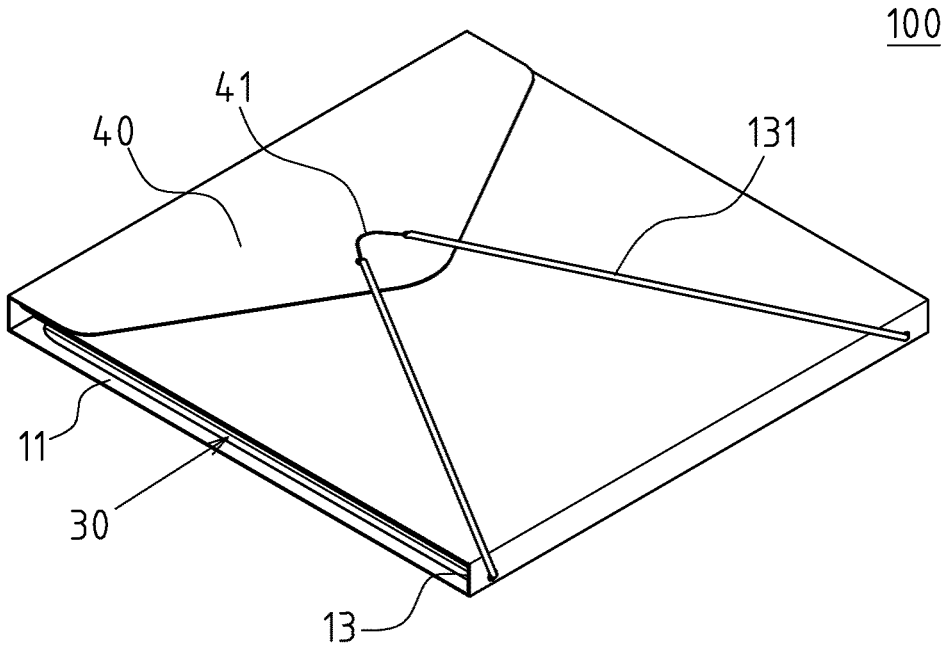
FIG. 1 is the three-dimensional outside view of the base plate in folded mode in the preferred embodiment of the present invention.
Figure 2:
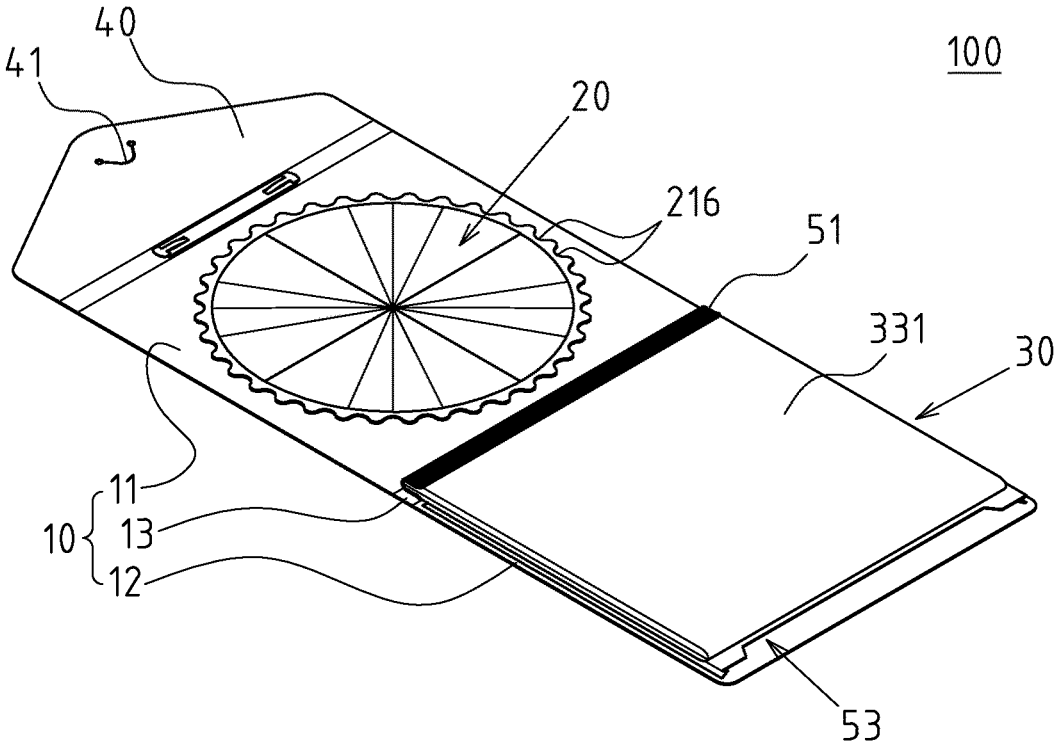
FIG. 2 is the stereogram of the base plate in open mode in the preferred embodiment of the present invention.
Figure 3:
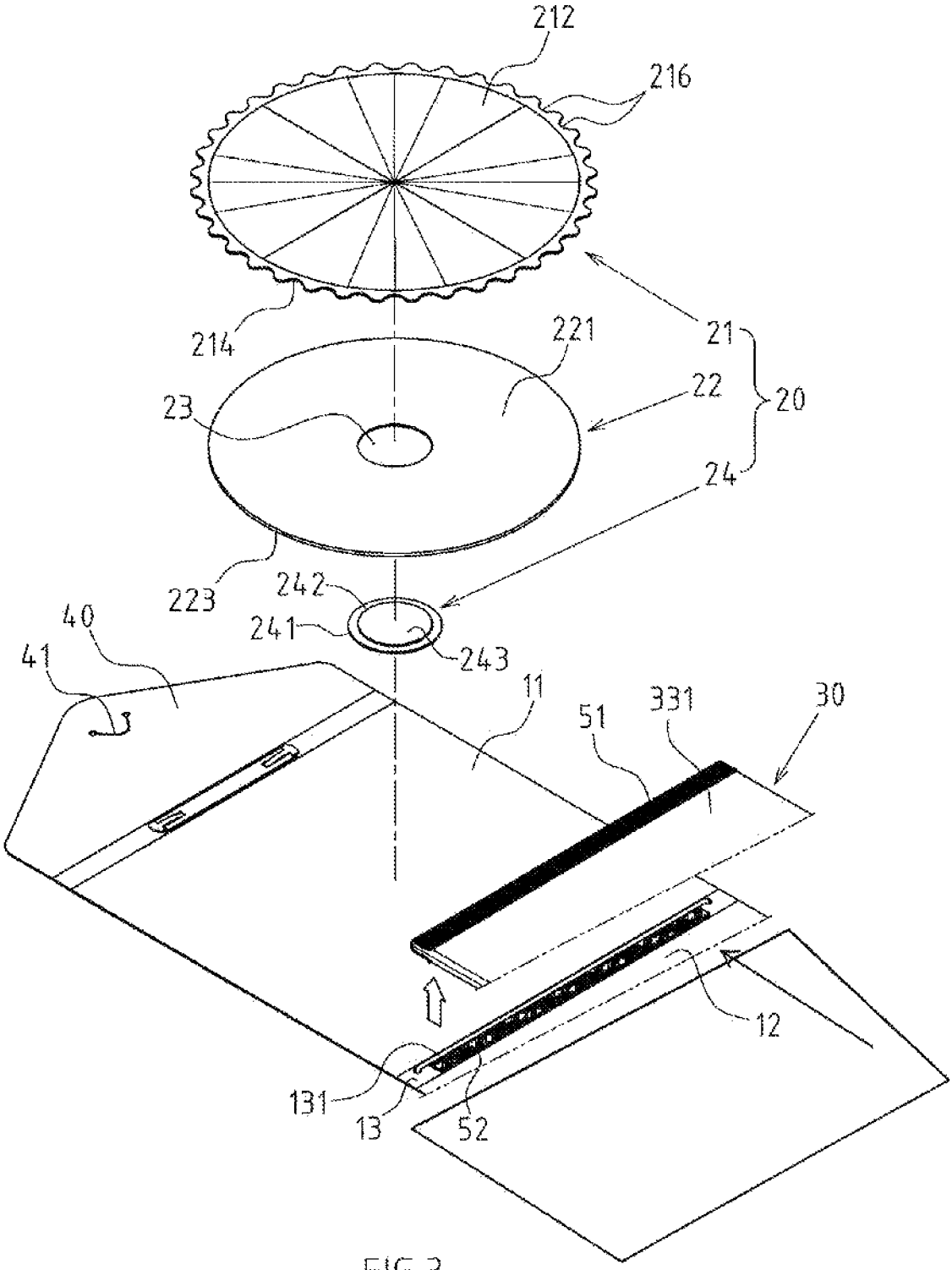
FIG. 3 is the exploded view of the rotary cutting mat component in the preferred embodiment of the present invention.
Figure 4:
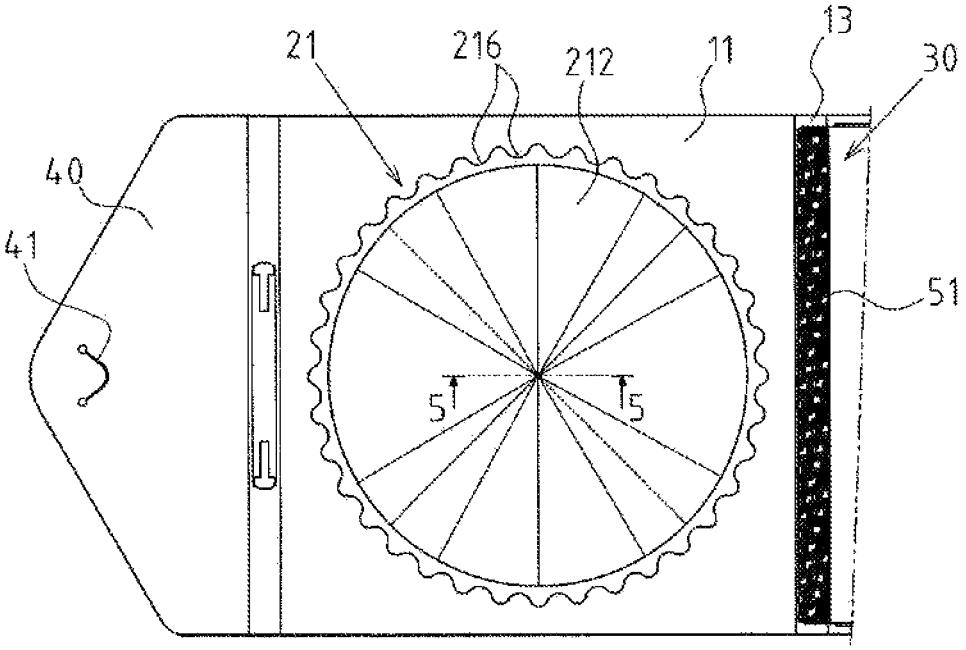
FIG. 4 is the top view of local structure in the preferred embodiment of the present invention.

As shown in FIG. 1 to FIG. 3, in this case, a folding face plate 40 extends from the outside of the second page 12 of the base plate 10, the folding face plate 40 can optionally cover the foldable cutting mat 20, the folding face plate 40 is provided with a fastening seam 41; the folding joint page 13 of the base plate 10 is provided with an elastic hooking thread 131, when the folding face plate 40 is in closed state (as shown in FIG. 1), the elastic hooking thread 131 can be optionally stretched to hook the fastening seam 41, so as to limit the storage state of the rotary cutting mat 20 and the detachable ironing mat 30. In this case, the storage of the rotary cutting mat 20 and the detachable ironing mat 30 is steadier, so as to avoid the portable patchwork sewing tool kit being opened while it is being carried with the user. In addition, the folding face plate 40 fully or partially covers the foldable cutting mat 20.

Figure 7:
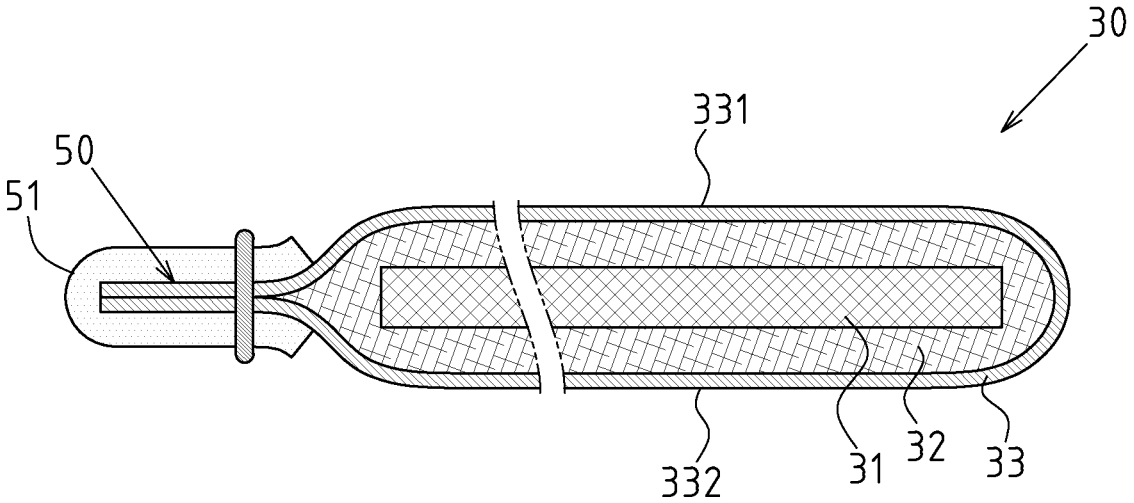
FIG. 7 is the sectional view of the detachable ironing mat in preferred embodiment of the present invention.

As shown in FIG. 7, in this case, a first ironing face 331 and a second ironing face 332 arranged oppositely are formed outside the cotton fabric surface layer 33 of the detachable ironing mat 30. There is a side wire for installation 50 on one side of the cotton fabric surface layer 33, the side wire for installation 50 has an installation component 51. As shown in FIG. 3, the folding joint page 13 is provided with an additional fixing part 52, so that the installation component 51 can be detachable on the additional fixing part 52; and the additional fixing part 52 and the installation component 51 are in any of the following detachable combined positioning fittings forms, male and female Velcro fittings (as shown in FIG. 3), punching and hole clamp fittings, magnetic attraction fittings or male and female fastener fittings.

Wherein the core board 31 of the detachable ironing mat 30 is a plastic foam board, the plastic foam board is made by foaming any of the following plastic materials: Polyvinyl Chloride (PVC), Polyvinyl alcohol (PVA), Polyethylene (PE), Polyurethane (PU), Ethylene Vinyl Acetate (EVA) and Expandable Polyethylene (EPE). The core board 31 disclosed in this case is a plastic foam board, the weight of the detachable ironing mat 30 can be reduced, the portable patchwork sewing tool kit is lightened, easier to be carried with the user.

Wherein the bottom plate 22 of the rotary cutting mat 20 is made of any of the following rigid plastic materials: PVC (Polyvinyl Chloride), PP (Polypropylene) or PS (Polystyrene).

Figure 9:
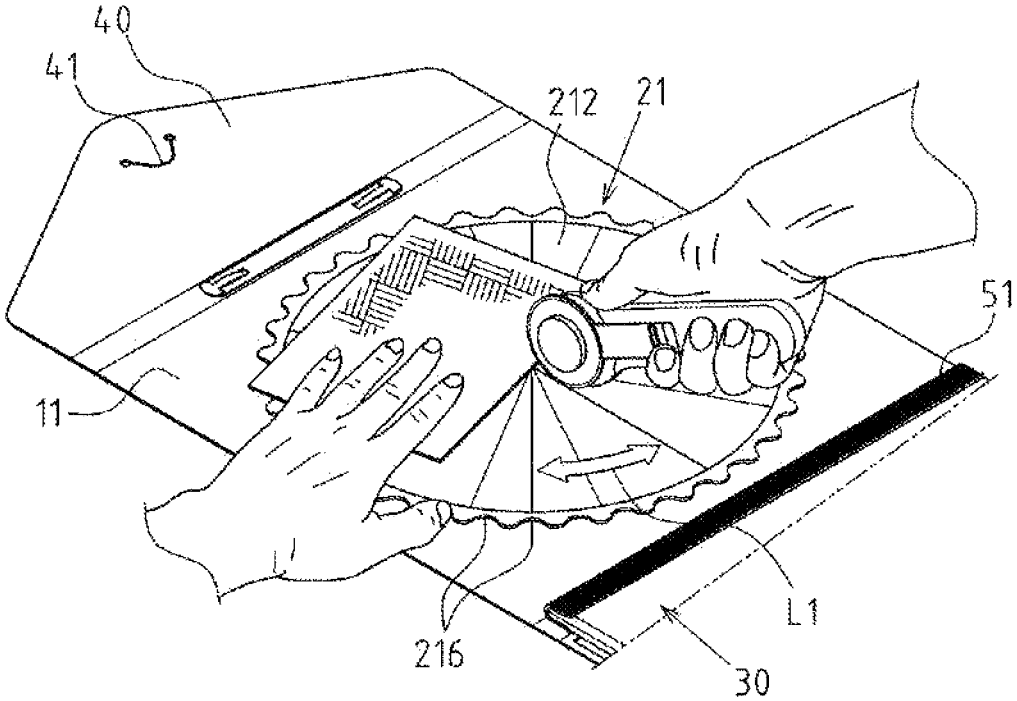
FIG. 9 is the schematic diagram of service mode in the preferred embodiment of the present invention.

Based on the aforesaid structural composition and technical characteristic, the actuation of the present invention is described below. When a user is to use the portable patchwork sewing tool kit, as shown in FIG. 2, the first page 11 and the second page 12 of the base plate 10 are unfolded, the user can perform cutting and ironing operation in this mode. In terms of cutting function, as the cutting plate pad 21 of rotary cutting mat 20 is screwed on the bottom plate 22 through the pivot joint base 24 to be rotatable and restrained, when the user wants to cut some arc, round and curve shapes or to change the cutting direction, the cutting plate pad 21 can be turned as assistance, the hand holding the cutting tool can turn without pressing. If the user wants to change the cutting direction, the fabric cutting direction can be changed by turning the cutting plate pad 21 (Arrow L1 in FIG. 9), so that some difficult cutting and redirected cutting actions can be done easily, smoothly and rapidly.

It is noteworthy that the function of the pushing edges 216 formed around the cutting plate pad 21 is that when the user wants to push the cutting plate pad 21 by hand, the concave or convex shape of the pushing edges 216 can increase the frictional drag, easier to push without slip. In terms of ironing function, to perform the material ironing operation, the first ironing face 331 or the second ironing face 332 of the detachable ironing mat 30 can be chosen according to the user's ironing habit. In addition, the detachable ironing mat 30 can be combined with the second page 12 of the base plate 10 directly before use, or detached and used in other occasions. To fold the portable patchwork sewing tool kit after use, as shown in FIG. 3, if the detachable ironing mat 30 is detached, the detachable ironing mat 30 can be fixed on the additional fixing part 52 at first, and then the first page 11 and the second page 12 of the base plate 10 are folded up (as shown in FIG. 1), thus the portable patchwork sewing tool kit can be stored easily. In this storage state, the volume of the portable patchwork sewing tool kit is half of that in said service mode, so it does not occupy space, and the components of the present invention are light plastics and fabric, it is portable. Therefore, the overall structure of the present invention really has such advantages as portability, light weight, easy push, convenient replacement and cleaning, and the flexibility of cutting and ironing operation is enhanced greatly, so as to meet the users' multiple requirements.

Figure 10:
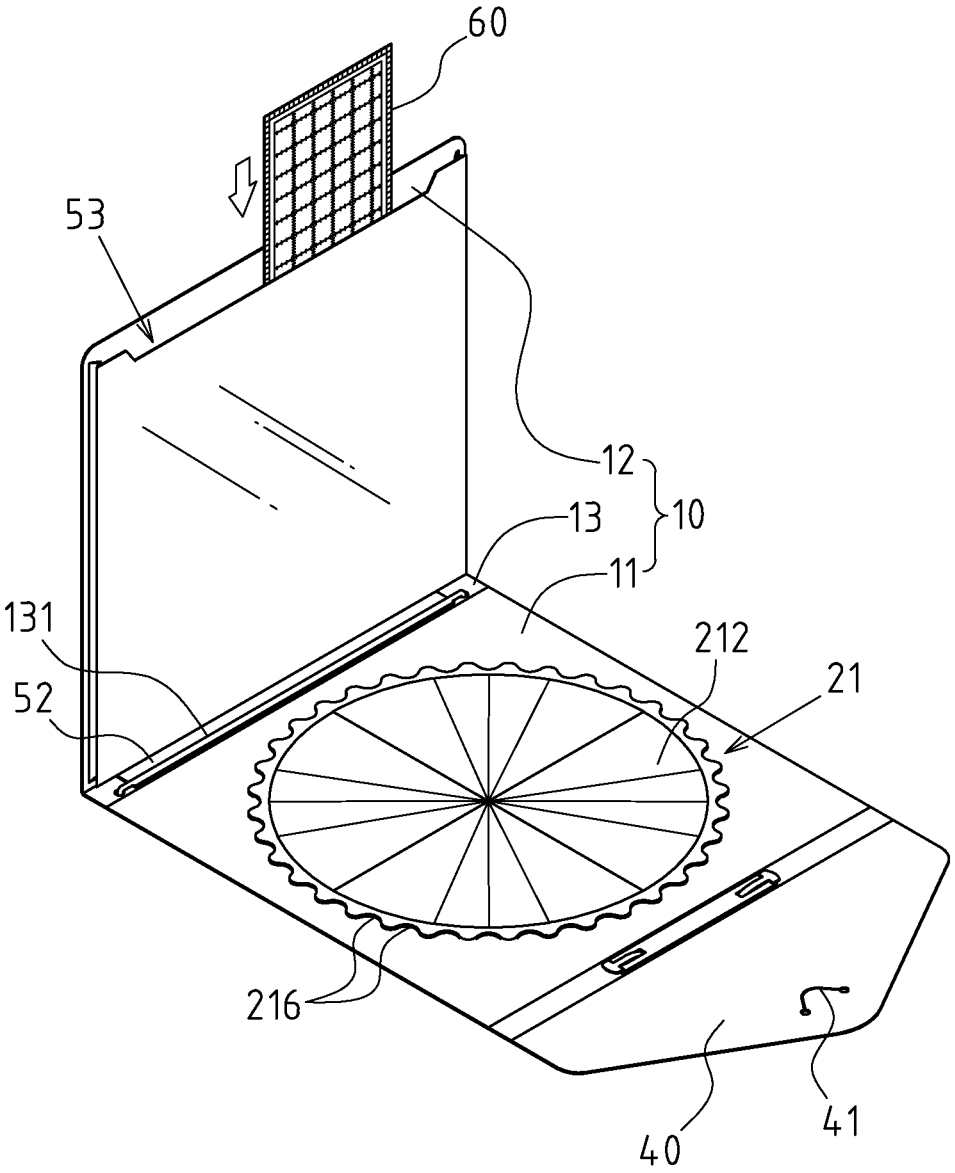
FIG. 10 is the schematic diagram of the storage interlayer for fittings in the preferred embodiment of the present invention.

As shown in FIG. 10, in this case, the second page 12 of the base plate 10 is provided with a storage interlayer 53 in a position different from the additional fixing part 52; the storage interlayer 53 can store such fittings as sewing ruler 60, patchwork pieces and cutting knives, so as to enhance the storage function and usability.

Figure 8:
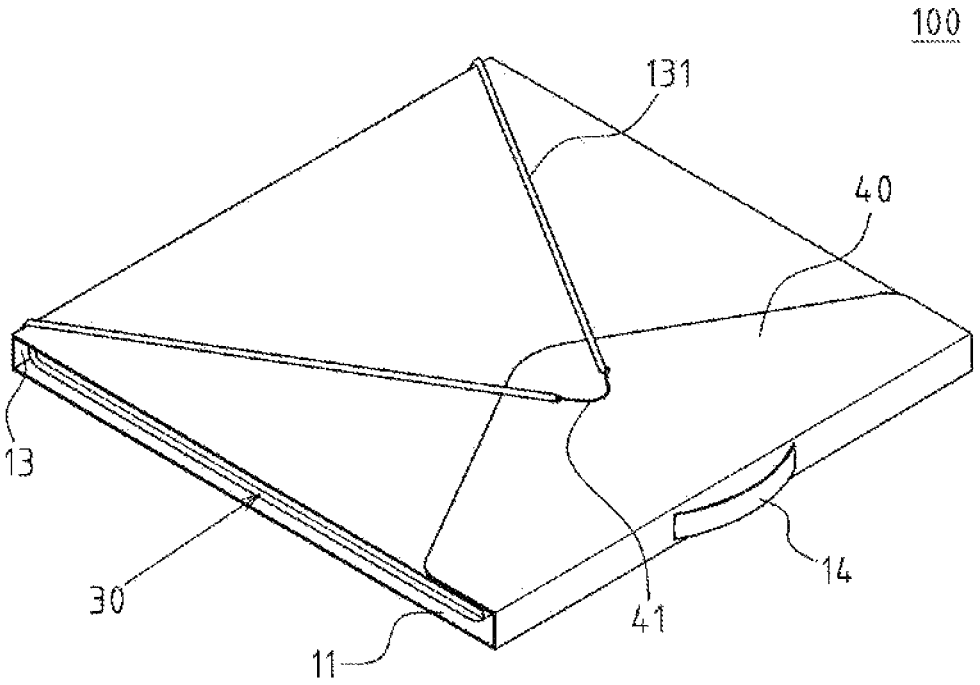
FIG. 8 is the three-dimensional outside view from another view angle of the preferred embodiment of portable patchwork sewing tool kit of the present invention.

As shown in FIG. 8, in this case, the base plate 10 can be provided with a carrying handle 14; the carrying handle 14 is like that of a brief case, favorable for carrying.

Figure 6:
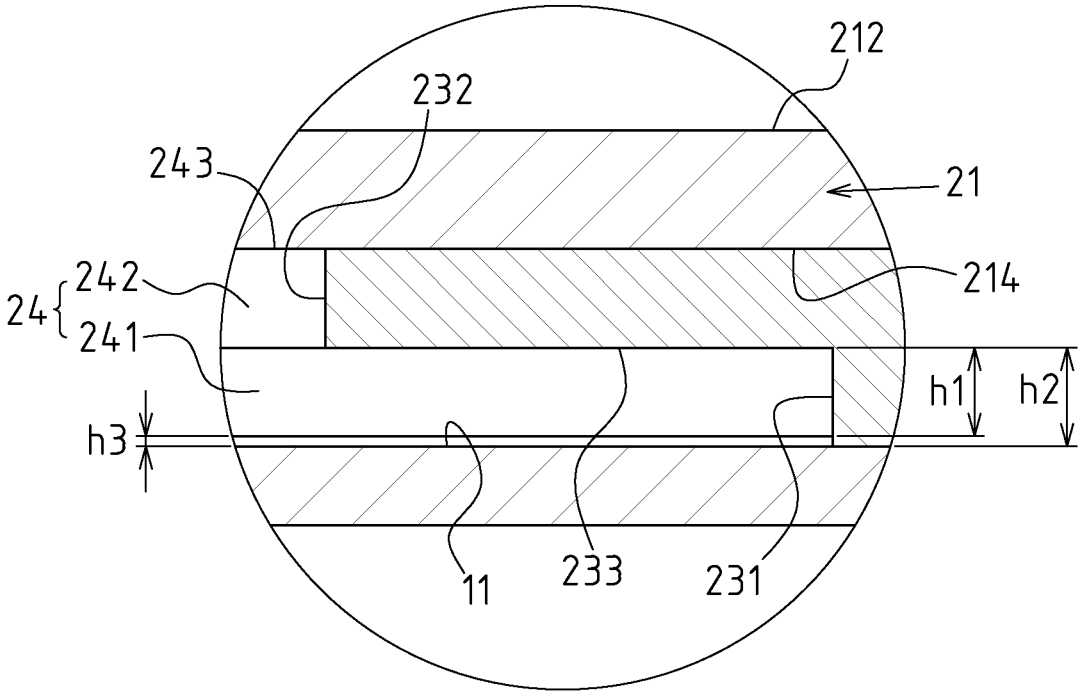
FIG. 6 is the close-up view of FIG. 5.

As shown in FIGS. 5 and 6, in this case, the thickness (h1) of the hole enlargement part 241 of the pivot joint base 24 is smaller than the thickness (h2) of the first hole part 231 of the stepped axle hole 23, forming a clearance (h3) between the hole enlargement part 241 and the first page 11. The form disclosed in this case avoids the lower end of the hole enlargement part 241 of the pivot joint base 24 contacting the first page 11, so as to reduce the frictional drag when the pivot joint base 24 is rotating.

Wherein the end face 243 of the coupling part 242 of the pivot joint base 24 is combined with the friction surface 214 of the cutting plate pad 10 by bonding, ultrasonic fusion, infrared fusion or vibration friction fusion.

I claim:

1. A portable patchwork sewing tool kit comprising:

a base plate having an inner face and a back side, the base plate having a first page and a second page which can be folded and unfolded, the first page and the second page being connected by a folding joint page;

a rotary cutting mat having a cutting plate pad with a cutting face and a friction surface, said rotary cutting mat having a bottom plate superposed under the cutting plate pad, the bottom plate having an upper side face and a lower side face, the bottom plate having a stepped axle hole, the stepped axle hole vertically penetrating through the upper side face and the lower side face, wherein the upper side face is over a portion of the friction surface of the cutting plate pad, the lower side face being fixed to the first page of said base plate, the stepped axle hole comprises a first hole part having a hole size different than a hole size of a second hole part thereof, the stepped axle hole having an annular shoulder between the first hole part and the second hole part, the stepped axle hole having a pivot joint base screwed therein, the pivot joint base comprising a hole enlargement part and a coupling part, the hole enlargement part having an outside diameter that is different than an outside diameter of the coupling part, wherein the hole enlargement part is aligned with the first hole part of the stepped axle hole, the coupling part being aligned with the second hole part of the stepped axle hole, the coupling part having an end face fixed to the friction surface of the cutting plate pad, wherein the cutting plate pad is screwed on the bottom plate through the pivot joint base; and a detachable ironing mat installed on the second page of said base plate, said detachable ironing mat comprising:

a core board;

a cotton spreading layer covering said core board;

a cotton fabric surface layer covering said cotton spreading layer; and a plurality of pushing edges formed around the cutting plate pad, said plurality of pushing edges being spaced apart from each other, each of said plurality of pushing edges being either concave or convex.

2. The portable patchwork sewing tool kit of claim 1, further comprising:

a folding face plate extending from said base plate, said folding face plate adapted to cover said rotary cutting mat, said folding face plate having a fastening seam, the folding joint page of said base plate having an elastic hooking thread, the elastic hooking thread being stretchable to hook the fastening seam when the folding face plate is closed.

3. The portable patchwork sewing tool kit of claim 2, wherein said folding face plate fully or partially covers said rotary cutting mat.

4. The portable patchwork sewing tool kit of claim 3, wherein said detachable ironing mat has a first ironing face and a second ironing face arranged opposite to each other.

5. The portable patchwork sewing tool kit of claim 4, wherein said cotton fabric surface layer has a side wire installed on one side thereof, the side wire having an installation component, wherein the folding joint page has a fixing part, the installation component being detachably mounted to the fixing part, wherein the installation component and the fixing part are selected from the group of detachable combined positioning fittings consisting of male-and-female hook-and-loop fittings, punching and hole clamp fittings, magnetic attraction fittings and male-and-female fastener fittings.

6. The portable patchwork sewing tool kit of claim 5, wherein said core board is a plastic foam board, the plastic foam board being formed of a foamed material selected from the group consisting of polyvinyl chloride, polyvinyl alcohol, polyethylene, polyurethane, ethylene vinyl acetate and expandable polyethylene.

7. The portable patchwork sewing tool kit of claim 6, wherein the second page of said base plate has a storage interlayer.

8. The portable patchwork sewing tool kit of claim 7, wherein the folding page joint has a carrying handle.

9. The portable patchwork sewing tool kit of claim 8, wherein the bottom plate is formed of a material selected from the group consisting of polypropylene, polyvinyl chloride and polystyrene.

10. The portable patchwork sewing tool kit of claim 9, wherein the hole enlargement part has a thickness that is less than a thickness of the first hole part of the stepped axle hole so as to define a clearance between the hole enlargement part and the first page.

11. The portable patchwork sewing tool kit of claim 10, wherein the end face of the coupling part of the pivot joint base is combined with the friction surface of the cutting plate pad by bonding.

12. The portable patchwork sewing tool kit of claim 10, wherein the end face of the coupling part of the pivot joint base is combined with the friction surface of the cutting plate pad by ultrasonic fusion.

13. The portable patchwork sewing tool kit of claim 10, wherein the end face of the coupling part of the pivot joint base is combined with the friction surface of the cutting plate pad by infrared fusion.

14. The portable patchwork sewing tool kit of claim 10, wherein the end face of the coupling part of the pivot joint base is combined with the friction surface of the cutting plate pad by vibration friction fusion.

* * * * *